US009648927B2

(12) United States Patent
Hung

(10) Patent No.: US 9,648,927 B2
(45) Date of Patent: May 16, 2017

(54) WARP-KNITTED TAPE OF ZIPPER

(71) Applicant: CHARM YOUNG INDUSTRY CO., LTD., Changhua County (TW)

(72) Inventor: Da-An Hung, Changhua County (TW)

(73) Assignee: CHARM YOUNG INDUSTRY CO., LTD., Changhua County (TW)

( * ) Notice: Subject to any disclaimer, the term of this patent is extended or adjusted under 35 U.S.C. 154(b) by 103 days.

(21) Appl. No.: 14/789,385

(22) Filed: Jul. 1, 2015

(65) Prior Publication Data

US 2016/0249710 A1 Sep. 1, 2016

(30) Foreign Application Priority Data

Feb. 26, 2015 (TW) ..... 104203002 U

(51) Int. Cl.
*D04B 21/20* (2006.01)
*A44B 19/34* (2006.01)

(52) U.S. Cl.
CPC ..... *A44B 19/343* (2013.01); *D04B 21/20* (2013.01)

(58) Field of Classification Search
CPC ..... D04B 21/20; D04B 21/202; A44B 19/343
USPC ..... 66/192, 193, 195
See application file for complete search history.

(56) References Cited

U.S. PATENT DOCUMENTS 4,265,003 A * 5/1981 Matsuda ..... A44B 19/343 24/393
4,279,134 A * 7/1981 Matsuda ..... A44B 19/343 66/195
4,378,683 A * 4/1983 Matsuda ..... A44B 19/343 24/393
4,409,802 A * 10/1983 Matsuda ..... A44B 19/343 24/381
4,419,868 A * 12/1983 Matsuda ..... A44B 19/343 66/195
4,442,685 A * 4/1984 Matsuda ..... A44B 19/343 66/193
4,498,316 A * 2/1985 Matsuda ..... A44B 19/343 66/193
4,677,011 A * 6/1987 Matsuda ..... A44B 18/0034 428/100
4,838,044 A * 6/1989 Matsuda ..... A44B 18/0034 66/190
5,257,515 A * 11/1993 Ikeguchi ..... A44B 19/343 24/393
5,586,454 A * 12/1996 Matsuda ..... A44B 19/343 24/393
5,685,177 A * 11/1997 Matsuda ..... A44B 19/343 66/193
5,706,677 A * 1/1998 Matsuda ..... A44B 19/343 24/393
6,082,148 A * 7/2000 Wakai ..... A44B 19/343 66/192
6,180,545 B1 * 1/2001 Okeya ..... A44B 19/343 442/232

(Continued)

*Primary Examiner* — Danny Worrell
(74) *Attorney, Agent, or Firm* — WPAT, PC; Justin King; Jonathan Chiang

(57) ABSTRACT

A warp-knitted tape, having a longitudinal direction, a left hand and a right hand sides parallel and opposite to each other and perpendicular to the longitudinal direction, and a plurality of wales extending parallel to each other along the longitudinal direction, is provided. The tape is made of a plurality of first, second and third yarns lapped according to specific knitting/lapping patterns.

9 Claims, 6 Drawing Sheets

(56) References Cited

U.S. PATENT DOCUMENTS 6,886,368 B2 * 5/2005 Matsuda ..... A44B 19/343
66/192
7,610,777 B1 * 11/2009 Hung ..... D04B 21/14
66/193

* cited by examiner

WARP-KNITTED TAPE OF ZIPPER

CROSS-REFERENCE TO RELATED APPLICATION AND CLAIM OF PRIORITY

This application claims the benefit of Taiwan Patent Application Serial No. 104203002, filed Feb. 26, 2015, the disclosures of which are incorporated herein by reference.

FIELD OF THE INVENTION

The present disclosure relates to a warp-knitted tape, and more particularly to a warp-knitted tape of a concealed zipper.

DESCRIPTION OF THE PRIOR ART

According to various fabric arts, in a warp-knitting process, yarns are parallel arranged in advance on warp beams in coil forms, and then pulled away from the respective warp beams to be further laid separately and orderly on corresponding knitting needles of a warp-knitting machine to be knitted into a warp-knitted textile. In the warp-knitting process, the textile is formed by yarn loops locked and extending in a warp direction and connected in a weft direction.

By taking a zipper as an example, the zipper generally includes a pair of tapes, a pair of teeth and a zipper slider. The teeth are fixed to the respective tapes, and the zipper slider is to control an engagement and separation of the teeth. While in application, the zipper is sewed at a position intended to be opened and closed on a cloth or a handbag.

While the zipper is used, it at least sustains transverse tensile forces perpendicular to a longitudinal direction. In particular, the zipper used on a handbag or a feminine body suit sustains strong transverse tensile forces. However, since the teeth are usually made of nylon monofilaments or the like having relatively higher fracture strength, hence when the zipper sustains the transverse tensile forces, the edges of the conjunction portions of the teeth and the tapes become the place that is weakest and easiest to be broken.

SUMMARY OF THE INVENTION

An object of the present disclosure is to provide a warp-knitted tape, which uses three knitting patterns to enlarge spaces between wales nearby either side of the tape and to enhance transverse rupture strength of the tape.

In another aspect, the present disclosure discloses a warp-knitted tape, having a longitudinal direction, a left hand and a right hand sides parallel and opposite to each other and perpendicular to the longitudinal direction, and a plurality of wales extending parallel to each other along the longitudinal direction, comprising: a plurality of first yarns, each of which is knitted and chain-stitched to extend along the longitudinal direction L; a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from each of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns.

In another aspect, the present disclosure discloses a warp-knitted tape, having a longitudinal direction, a left hand and a right hand sides parallel and opposite to each other and perpendicular to the longitudinal direction, and a plurality of wales extending parallel to each other along the longitudinal direction, comprising: a plurality of first yarns, each of which is knitted and chain-stitched to extend along the longitudinal direction L; a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from either of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns.

All these objects can be achieved at least by the warp-knitted tape described below.

BRIEF DESCRIPTION OF THE DRAWINGS

The present invention will now be specified with reference to embodiments illustrated in the drawings, in which.

DETAILED DESCRIPTION

The present disclosure is directed to a warp-knitted tape capable of being applied to a zipper, especially to a concealed zipper. In the following description, numerous details are set forth in order to at least provide a thorough understanding of the present tape. It will be appreciated by one skilled in the art that variations of these specific details are possible while still achieving the results disclosed in the present disclosure.

Figure 1:
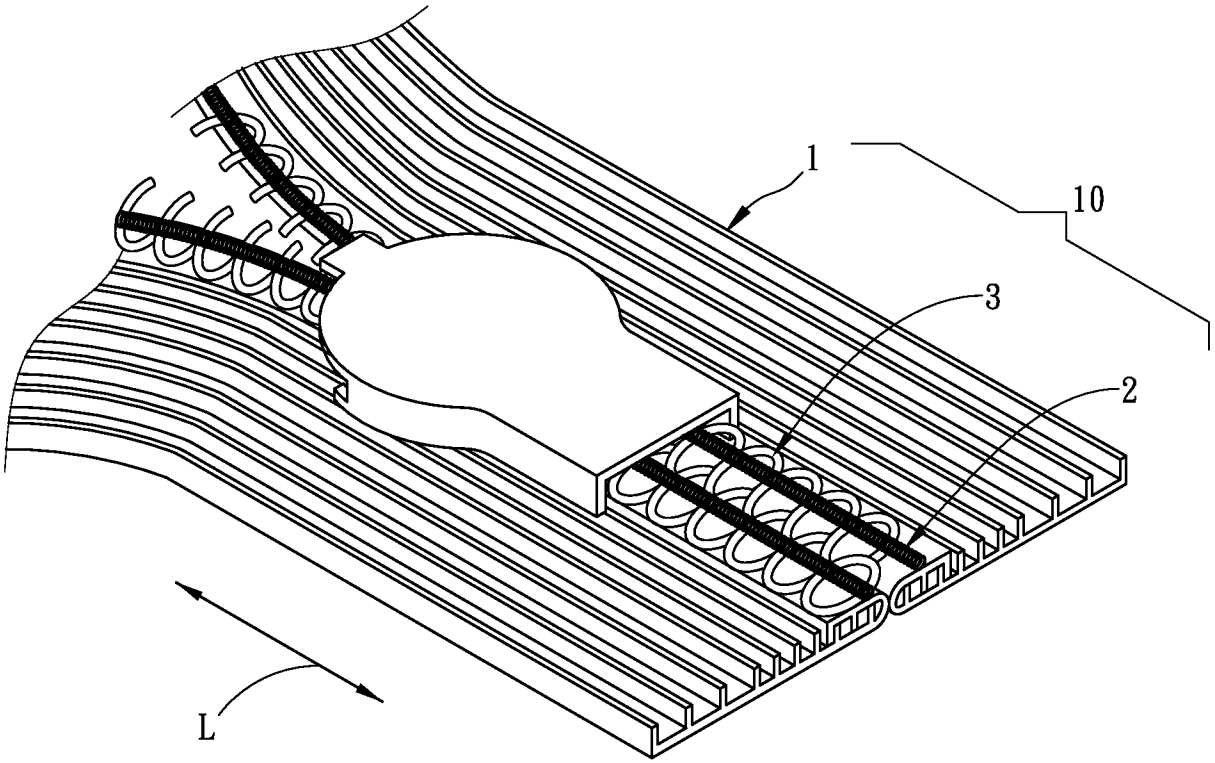
FIG. 1 is a schematic perspective view of a portion of a zipper.
Figure 2C:
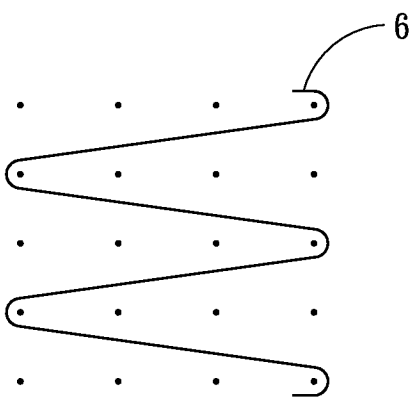
FIG. 2A, FIG. 2B, FIG. 2C, FIG. 2D and FIG. 2E demonstrate various lapping movements of yarn in a tape of the zipper.
Figure 2B:
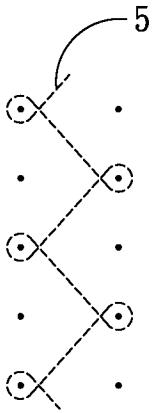
Figure 2A:
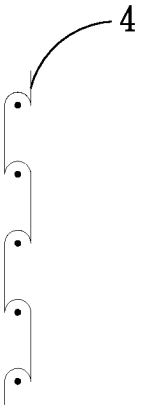
Figure 2E:
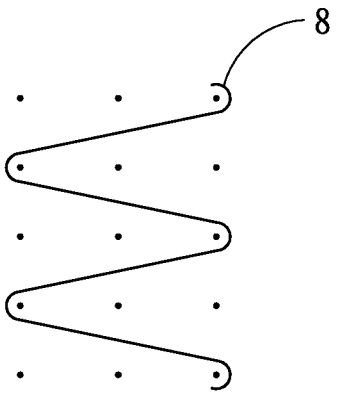
Figure 2D:
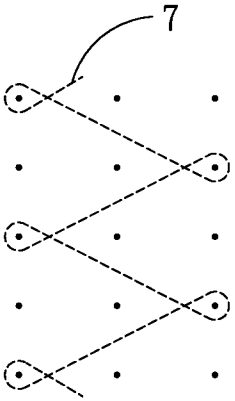
Figure 3:
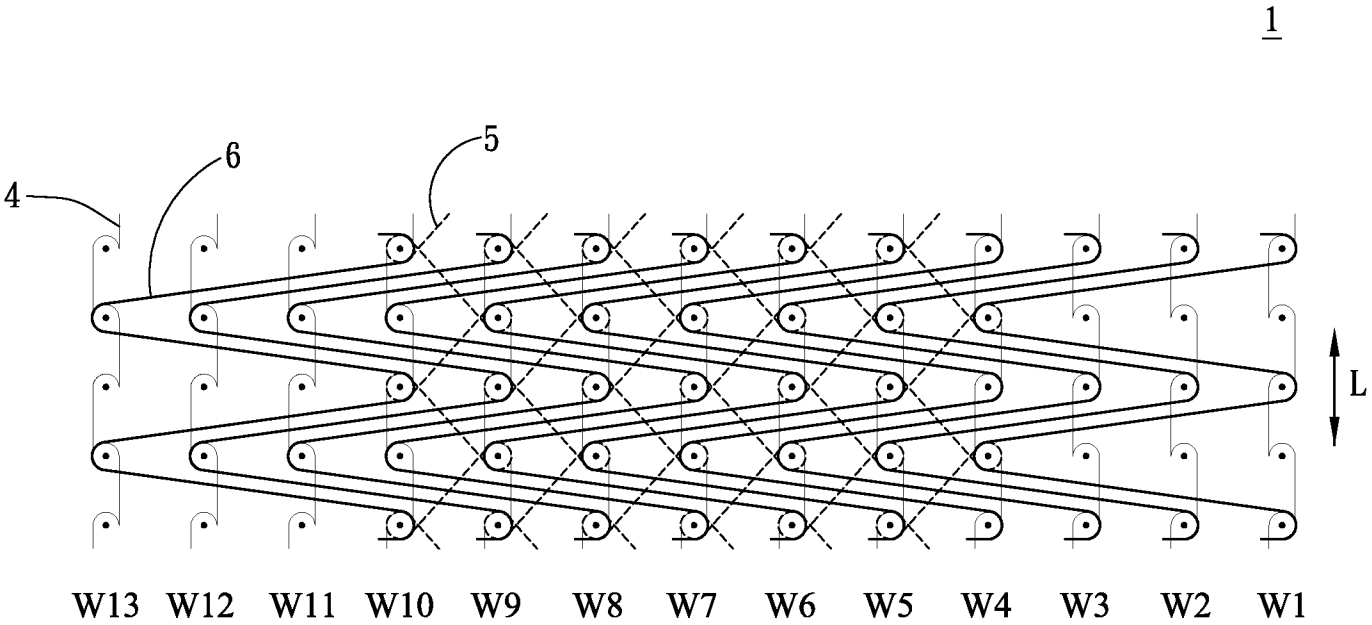
FIG. 3 is an enlarged view of the tape.

Refer now to FIG. 1, FIG. 2A through FIG. 2E and FIG. 3, where FIG. 1 is a schematic perspective view of a portion of a zipper 10, FIG. 2A to FIG. 2E demonstrate various lapping movements of yarn of the tape, and FIG. 3 is an enlarged view of the tape.

The zipper 10 includes a pair of tapes 1, a pair of fixing threads 2, and a pair of zipper teeth 3 sewed to the tapes 1 by using the fixing threads 2. The tape 1 has a longitudinal direction L, a left hand and a right hand sides parallel and opposite to each other and perpendicular to the longitudinal direction, and thirteen wales extending parallel to each other along the longitudinal direction L. The wales are ribs slightly protruding from a surface of the tape 1, and respectively represented by W1, W2, W3, W4, W5, W6, W7, W8, W9, W10, W11, W12 and W13 as shown in FIG. 3.

The tape 1 includes a plurality of first yarns 4, a plurality of second yarns 5 and a plurality of third yarns 6.

As shown in FIG. 2A, the first yarn 4 is lapped according to a 1-0/0-1 chain stitch pattern. As shown in FIG. 2B, the second yarn 5 is lapped according to a 1-2/1-0 tricot stitch pattern. As shown in FIG. 2C, the third yarn 6 is lapped according to a 0-0/4-4 laid-in stitch pattern. Through the aforesaid three specifically lapped yarns, the tape 1 is formed, where the lapping movements of the yarns 4, 5 and 6 in the tape 1 are shown in FIG. 3. All of the plurality of first, second and third yarns 4, 5 and 6 are knitted to form the corresponding specific patterns extended along the longitudinal direction L to extend the tape 1.

The plurality of first yarns 4 are chain-stitched and extended and at least cooperate with the respective third yarns 6 to form the corresponding wales (W1 to W13) along the longitudinal direction L.

Specifically, the first one (counted from the right hand side of the tape 1) of the first yarns 4 moves to the left and the right repeatedly via the 1-0/-01 knitting pattern, and cooperates with the first one (counted from the right hand side of the tape 1) of the third yarns 6 to form a first wale W1, where the knitting pattern of the first one of first yarns 4 is so celled as W1/W1. Similarly, the respective knitting patterns of the second to the thirteenth ones (counted from the right hand side of the tape 1) of first yarns 4 are so called as W2/W2, W3/W3, W4/W4, W5/W5, W6/W6, W7/W7, W8/W8, W9/W9, W10/W10, W11/W11, W12/W12 and W13/W13 as shown in FIG. 2A and FIG. 3, where the wales of W11, W12 and W13 are form by the eleven one of the first yarns 4 cooperating with the eighth one (counted from the right hand side of the tape 1) of the third yarns 6, the twelfth one of the first yarns 4 cooperating with the ninth one (counted from the right hand side of the tape 1) of the third yarns 6, and the thirteenth one of the first yarns 4 cooperating with the tenth one (counted from the right hand side of the tape 1) of the third yarns 6 respectively.

As shown in FIG. 2B, the second yarn 5 is knitted and winds to move to the left and the right repeatedly in a zigzag pattern between two neighboring and sequential wales (two neighboring first yarns 4), and therefore there is no wale between the two neighboring wales. In the tape 1, at least one second yarn 5 is omitted at either side, i.e. the right hand and the left hand sides, of the tape 1. Namely, no second yarn 5 (W2/W1) is knitted between the second wale W2 and the first wale W1, and no second yarn 5 (W13/W12) is knitted between the twelfth wale W12 and the thirteenth wale W13. In an embodiment, more than one second yarn 5 is omitted at either side of the tape 1.

As shown in FIG. 3, in a middle, relatively compact portion of the tape 1, one second yarn 5 is knitted to zigzag between the fourth W4 and the fifth W5 wales (the fourth and the fifth ones of the first yarns 4), and the knitting pattern of this second yarn 5 is so called as W5/W4. Similarly, in the tape 1, there are another five second yarns 5 are knitted to separately and respectively zigzag between two corresponding and neighboring wales, and the respective knitting pattern of the five second yarn 5 are so called as W6/W5, W7/W6, W8/W7, W9/W8 and W10/W9 as shown in FIG. 3. Through the corresponding first, second and third yarns 4, 5, and 6 knitted with the specific knitting patterns, the wales of W4, W5, W6, W7, W8, W9 and W10 are formed.

Figure 4:
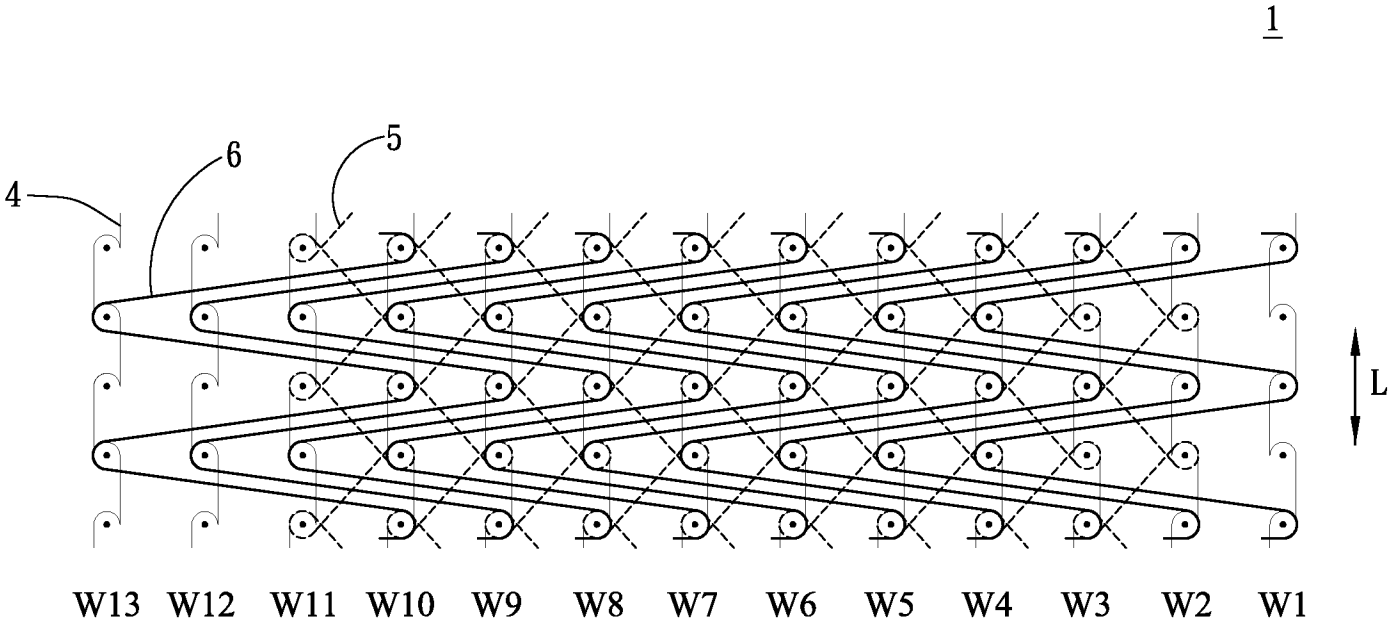
FIG. 4 is an enlarged view of another tape.

In an embodiment, the omissions of the second yarns 5, knitted by the 1-2/1-0 tricot stitch pattern, at the sides of the tape 1 are asymmetric. For example, in the tape 1, one second yarn 5 is omitted at one side, and two second yarns 5 are omitted at the opposite side. However, the number of the omitted second yarns 5 at either side of the tape 1 is optional prior to knitting the tape in accordance with demands. As shown in FIG. 4, in the tape 1, only one second yarn 5 (W2/W1) is omitted at the right hand side of the tape 1, while two second yarns 5 (W13/W12 and W12/W11) are omitted at the left hand side of the tape 1. Through the omissions of the second yarns 5 at either side of the tape 1, the spaces between the wales, where no second yarn 5 exists, are enlarged, so that, while sewing zipper teeth with tapes by using a high-speed twin-needle stitching machine, friction between the needles and tapes is reduced.

As shown in FIG. 2C, the third yarn 6 is knitted to move to the left and the right repeatedly in a zigzag pattern between four neighboring wales.

Specifically, one third yarn 6, knitted by the 0-0/4-4 knitting pattern, zigzags between the first and the fourth wales (the first and the fourth ones of the first yarns 4), and the knitting pattern of this third yarn 6 is so called as W1/W4. Similarly, in the tape 1, there are another nine third yarns 6 are knitted to separately and respectively zigzag between the corresponding and neighboring wales, and the respective knitting pattern of the nine third yarns 6 W2/W5, W3/W6, W4/W7, W5/W8, W6/W9, W7/W10, W8/W11, W9/W12 and W10/W13 as shown in FIG. 3.

It shall be noted that the first yarns 4, the second yarns 5 and the third yarns 6 in the figures of the present disclosure are represented by relatively thin lines, dashed lines and relatively bold lines respectively so as to distinguish these yarns on the figures, and neither to limit nor indicate the thicknesses of the yarns.

The tape 1 can be formed by the first yarns 4, the second yarns 5 and the third yarns 6 with their specific knitting patterns as mentioned above. In an embodiment, two third yarns 6, which are the respective first ones counted from the right hand and the left hand sides of the tape 1 and knitted according to the 0-0/4-4 laid-in stitch pattern, have a higher denier so as to enhance the transverse rupture strength of the tape 1. In addition, each of the two above-mentioned "first" third yarns 6 can be replaced by two yarns, which is another way to enhance the transverse rupture strength of the tape 1. Furthermore, the higher denier yarns can be applied to another two third yarns 6, which are the respective second ones counted from the right hand and the left hand sides of the tape 1 to achieve the strength-enhancing effect.

Figure 5:
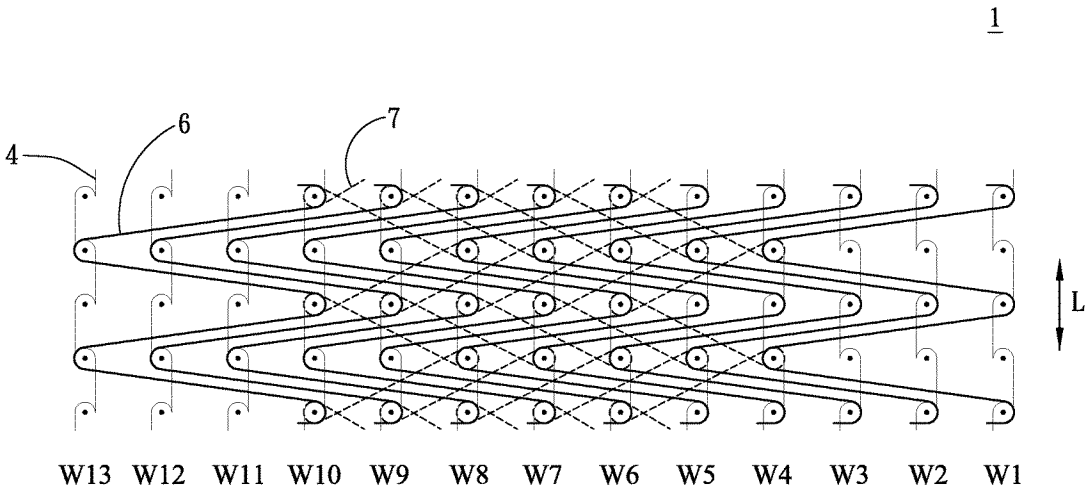
FIG. 5 is an enlarged view of a further tape.

As described above, the second yarns 5 are knitted according to the 1-2/1-0 knitting pattern. In another embodiment, a 2-3/1-0 knitting pattern is applied to the second yarn. As shown in FIG. 2D, a second yarn 7 knitted according to the 2-3/1-0 knitting pattern zigzags between three neighboring wales. Moreover, as shown in FIG. 5, the tape 1 has five second yarns 7 in its middle compact portion. One of the five second yarns 7 is knitted between the sixth and the fourth wales, and the knitting pattern of this second yarn 7 is so called W6/W4. Similarly, as shown in FIG. 5, the other four second yarns 7 are knitted according to the 2-3/1-0 knitting pattern to separately and respectively zigzag between the corresponding and neighboring wales, and their respective knitting patterns are so called W7/W5, W8/W6, W9/W7 and W10/W8.

As described above, the third yarn 6 are knitted according to the 0-0/4-4 knitting pattern. In another embodiment, a 0-0/3-3 knitting pattern can is applied to knit the third yarns. As shown in FIG. 2E, the third yarn 8 is knitted via the 0-0/3-3 knitting pattern to extend along a longitudinal direction L of tape and move to the left and the right repeatedly between three neighboring and sequential wales.

EMBODIMENTS

Embodiment 1 is a warp-knitted tape, having a longitudinal direction, a left hand and a right hand sides parallel and opposite to each other and perpendicular to the longitudinal direction, and a plurality of wales extending parallel to each other along the longitudinal direction, comprising: a plurality of first yarns, each of which is knitted and chain-stitched to extend along the longitudinal direction L; a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from each of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns.

Embodiment 2 is a tape described in Embodiment 1, wherein none of the plurality of second yarns is knitted between the second and a third ones, counted from each of the left hand and the right hand sides, of the plurality of wales.

Embodiment 3 is a tape described in either of Embodiments 2 and 3, wherein none of the plurality of second yarns is knitted between the third and a fourth ones, counted from each of the left hand and the right hand sides, of the plurality of wales.

Embodiment 4 is a tape described in any of Embodiments 1 to 3, wherein each of the plurality of third yarns is knitted to form a laid-in stitch.

Embodiment 5 is a warp-knitted tape, having a longitudinal direction, a left hand and a right hand sides parallel and opposite to each other and perpendicular to the longitudinal direction, and a plurality of wales extending parallel to each other along the longitudinal direction, comprising: a plurality of first yarns, each of which is knitted and chain-stitched to extend along the longitudinal direction L; a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from either of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns.

Embodiment 6 is a tape described in Embodiment 5, wherein none of the plurality of second yarns is knitted between the second and a third ones, counted from either of the left hand and the right hand sides, of the plurality of wales.

Embodiment 7 is a tape described in either of Embodiments 5 and 6, wherein none of the plurality of second yarns is knitted between the third and a fourth ones, counted from either of the left hand and the right hand sides, of the plurality of wales.

Embodiment 8 is a tape described in any of Embodiments 5 to 8, wherein each of the plurality of third yarns is lapped to form a laid-in stitch.

In summary, the tape 1 disclosed in the present invention is constructed at least by using the first, the second and the third yarns knitted via the specific knitting patterns. Specifically, one to three second yarns 5 are omitted at each of the right hand side and the left hand side of the tape 1 so as to enlarge the spaces between the wales nearby the sides of the tape 1. In addition, through the omissions of the second yarns 5, the wales located close to lateral edges of the tape 1 are relatively thin, the middle portion of the tape 1 is relatively compact, and a texture of the tape 1 gradually becomes sparser from the middle portion to the edges/sides of the tape 1. Moreover, the third yarns 6 are knitted via the 0-0/4-4 laid-in stitch pattern. Through the usage of high denier yarns near the sides of the tape 1, the transverse rupture strength of the zipper using the tape 1 is enhanced. Furthermore, the second yarns 7 knitted via the 2-3/1-0 knitting pattern and/or the third yarns 8 knitted via the 0-0/3-3 knitting pattern can be used to form the tape of the zipper.

While the present invention has been particularly shown and described with reference to the practical and preferred embodiments, it will be understood by those skilled in the art that various changes in form and detail may be without departing from the spirit and scope of the present invention.

What is claimed is:

1. A warp-knitted tape, having a longitudinal direction, a left hand and a right hand sides parallel and opposite to each other and perpendicular to the longitudinal direction, and a plurality of wales extending parallel to each other along the longitudinal direction, comprising:

a plurality of first yarns, each of which is knitted and chain-stitched to extend along the longitudinal direction L;

a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from each of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns;

wherein, the left hand side and the right hand side are asymmetric regarding the plurality of wales that are not knitted with the plurality of second yarns.

2. The warp-knitted tape of claim 1, wherein none of the plurality of second yarns is knitted between the second and a third ones, counted from each of the left hand and the right hand sides, of the plurality of wales.

3. The warp-knitted tape of claim 2, wherein none of the plurality of second yarns is knitted between the third and a fourth ones, counted from each of the left hand and the right hand sides, of the plurality of wales.

4. The warp-knitted tape of claim 1, wherein the plurality of third yarns are knitted to form corresponding laid-in stitches.

5. A warp-knitted tape, having a longitudinal direction, a left hand and a right hand sides parallel and opposite to each other and perpendicular to the longitudinal direction, and a plurality of wales extending parallel to each other along the longitudinal direction, comprising:

a plurality of first yarns, each of which is knitted and chain-stitched to extend along the longitudinal direction L;

a plurality of second yarns, each of which is knitted to extend along the longitudinal direction and move to the left and the right repeatedly to zigzag between at least two neighboring ones of the plurality of wales, wherein none of the plurality of second yarns is knitted between at least a first and a second ones, counted from either of the left hand and the right hand sides, of the plurality of wales; and a plurality of third yarns, each of which is knitted to extend along the longitudinal direction and move to the left and the right repeatedly to zigzag between at least three neighboring ones of the plurality of wales, wherein the plurality of wales are formed by the knitted first and third yarns;

wherein, the left hand side and the right hand side are asymmetric regarding the plurality of wales that are not knitted with the plurality of second yarns.

6. The warp-knitted tape of claim 5, wherein none of the plurality of second yarns is knitted between the second and a third ones, counted from either of the left hand and the right hand sides, of the plurality of wales.

7. The warp-knitted tape of claim 6, wherein none of the plurality of second yarns is knitted between the third and a fourth ones, counted from either of the left hand and the right hand sides, of the plurality of wales.

8. The warp-knitted tape of claim 5, wherein the plurality of third yarns are knitted to form corresponding laid-in stitches.

9. The warp-knitted tape of claim 1, wherein a first section of the left hand side consists of the plurality of first yarns and the plurality of third yarns knitted between the plurality of wales and a second section of the right hand side of the tape consists of the plurality of first yarns and the plurality of third yarns knitted between the plurality of wales, wherein the first section and second section respectively comprise at least one row of the plurality of wales in the longitudinal direction.

* * * * *